US012667168B1

(12) United States Patent
Mobley

(10) Patent No.: US 12,667,168 B1
(45) Date of Patent: Jun. 30, 2026

(54) SHOE CREASE ABATEMENT SYSTEM

(71) Applicant: David Allen Mobley, Atlanta, GA (US)

(72) Inventor: David Allen Mobley, Atlanta, GA (US)

( * ) Notice: Subject to any disclaimer, the term of this patent is extended or adjusted under 35 U.S.C. 154(b) by 0 days.

(21) Appl. No.: 19/357,188

(22) Filed: Oct. 14, 2025

(51) Int. Cl.
*A43D 3/14* (2006.01)

(52) U.S. Cl.
CPC ..... *A43D 3/14* (2013.01)

(58) Field of Classification Search
CPC ..... A43D 3/08; A43D 3/14; A43D 3/1433; A43D 3/1491; A43D 3/1441; A43D 3/1416
USPC ..... 12/114.2, 115.6, 119.5, 128 V
See application file for complete search history.

(56) References Cited

U.S. PATENT DOCUMENTS

| | | | | | |
|---|---|---|---|---|---|
| 507,845 | A * | 10/1893 | Richards | A43D 3/1416 | 12/114.6 |
| 640,869 | A * | 1/1900 | Browne | A43D 3/1441 | 12/136 R |
| 1,290,879 | A * | 1/1919 | Baruch | A43D 3/1466 | 12/115.6 |
| RE18,338 | E * | 1/1932 | Poole | A43D 3/022 | 12/141 |
| 2,473,207 | A * | 6/1949 | Kessler | A43D 3/1441 | D2/979 |
| 2,581,952 | A | 1/1952 | Henry | | |
| 4,149,290 | A * | 4/1979 | Sansen | A47G 25/005 | 12/114.8 |
| 5,244,233 | A * | 9/1993 | McCraney | A43B 23/24 | 132/73 |
| 6,883,197 | B2 | 4/2005 | Tak | | |
| D812,358 | S | 3/2018 | Garcia | | |
| 10,463,111 | B2 | 11/2019 | Przirembel | | |
| 12,292,064 | B2 | 5/2025 | Bue | | |
| 2006/0168742 | A1 | 8/2006 | Chang | | |
| 2008/0148607 | A1 | 6/2008 | Spar | | |
| 2020/0383430 | A1* | 12/2020 | Kuris | A43D 3/1433 | |
| 2025/0089854 | A1 | 3/2025 | Ciccola | | |

FOREIGN PATENT DOCUMENTS

| | | | | |
|---|---|---|---|---|
| GB | 190905613 | A * | 10/1909 | A43D 3/1466 |
| GB | 184109 | A * | 8/1922 | A43D 3/08 |
| GB | 2116831 | A * | 10/1983 | A43D 3/08 |
| WO | 2023031374 | | 3/2023 | |

* cited by examiner

*Primary Examiner* — Ted Kavanaugh
(74) *Attorney, Agent, or Firm* — Kyle A. Fletcher, Esq.

(57) ABSTRACT

The shoe crease abatement system may include a pair of shoe stretchers and shoe conditioner. The pair of shoe stretchers may be inserted into toe boxes of a pair of shoes and may stretch the toe boxes in a vertical direction to prevent creases from forming at folds across the tops of the pair of shoes. The shoe conditioner may be applied to the pair of shoes to soften the pair of shoes in preparation for stretching. As non-limiting examples, the pair of shoes may be sneakers, running shoes, or leather shoes.

19 Claims, 8 Drawing Sheets

SHOE CREASE ABATEMENT SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of shoe accessories and shoe stretchers, more specifically, a shoe crease abatement system.

SUMMARY OF INVENTION

The shoe crease abatement system may comprise a pair of shoe stretchers and shoe conditioner. The pair of shoe stretchers may be inserted into the toe boxes of a pair of shoes and may stretch the toe boxes in a vertical direction to prevent creases from forming at folds across the tops of the pair of shoes. The shoe conditioner may be applied to the pair of shoes to soften the pair of shoes in preparation for stretching. As non-limiting examples, the pair of shoes may be sneakers, running shoes, or leather shoes.

An object of the invention is to provide a pair of shoe stretchers configured to be inserted into the tow boxes of a pair of shoes.

Another object of the invention is to provide a top plate and a bottom plate shaped to conform to the inside of the toe box of a shoe.

A further object of the invention is to provide a plurality of top spring columns coupled to the top plate, a plurality of bottom spring columns coupled to the bottom plate and aligned with the plurality of top spring columns, and a plurality of helical springs located within the plurality of top spring columns and the plurality of bottom spring columns such that the top plate and the bottom are forced to separate vertically.

Yet another object of the invention is to provide a shoe conditioner that may be sprayed onto the show to soften the shoe.

These together with additional objects, features and advantages of the shoe crease abatement system will be readily apparent to those of ordinary skill in the art upon reading the following detailed description of the presently preferred, but nonetheless illustrative, embodiments when taken in conjunction with the accompanying drawings.

In this respect, before explaining the current embodiments of the shoe crease abatement system in detail, it is to be understood that the shoe crease abatement system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the shoe crease abatement system.

It is therefore important that the claims be regarded as including such equivalent construction insofar as they do not depart from the spirit and scope of the shoe crease abatement system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
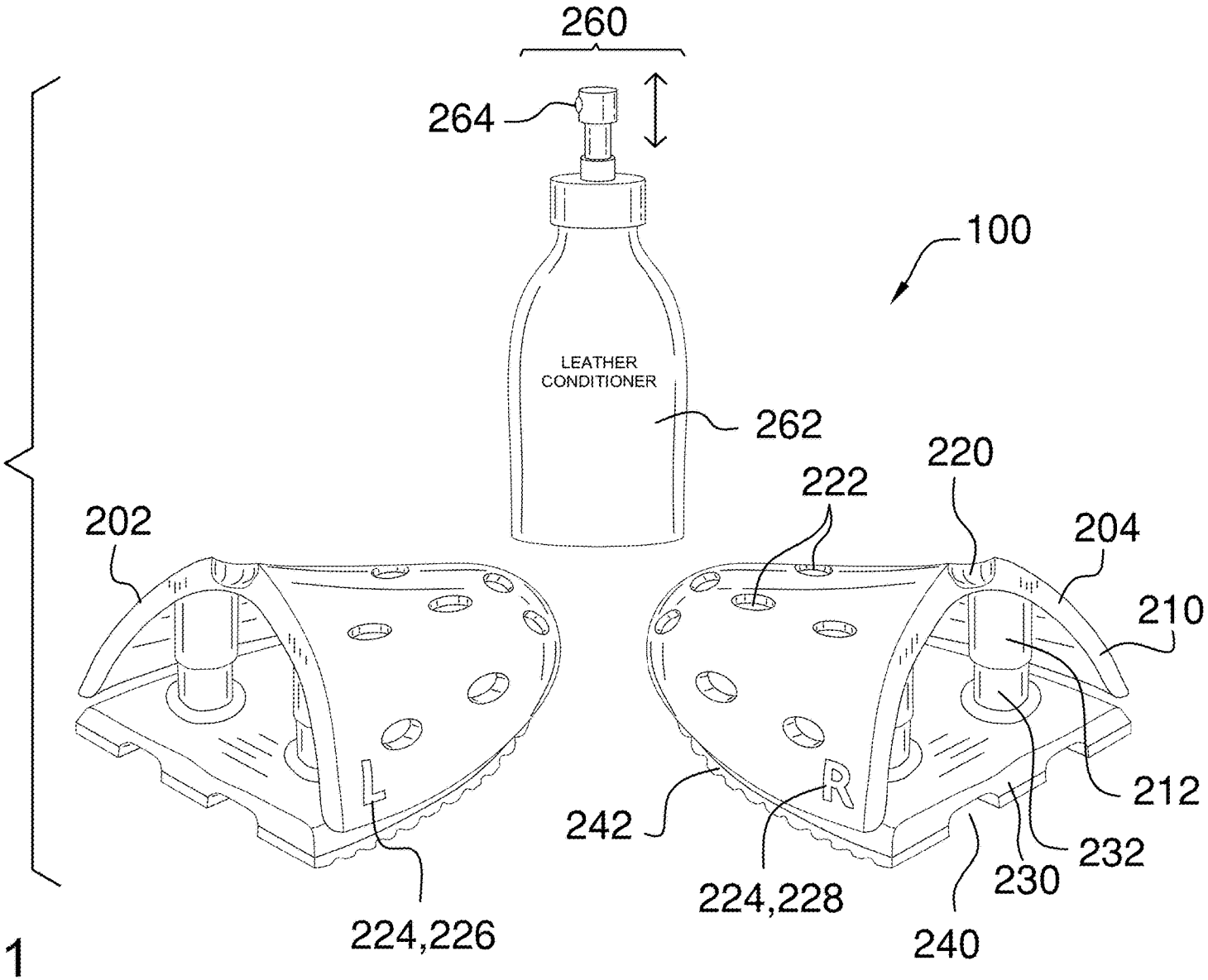
FIG. 1 is an isometric view of an embodiment of the disclosure.
Figure 2:
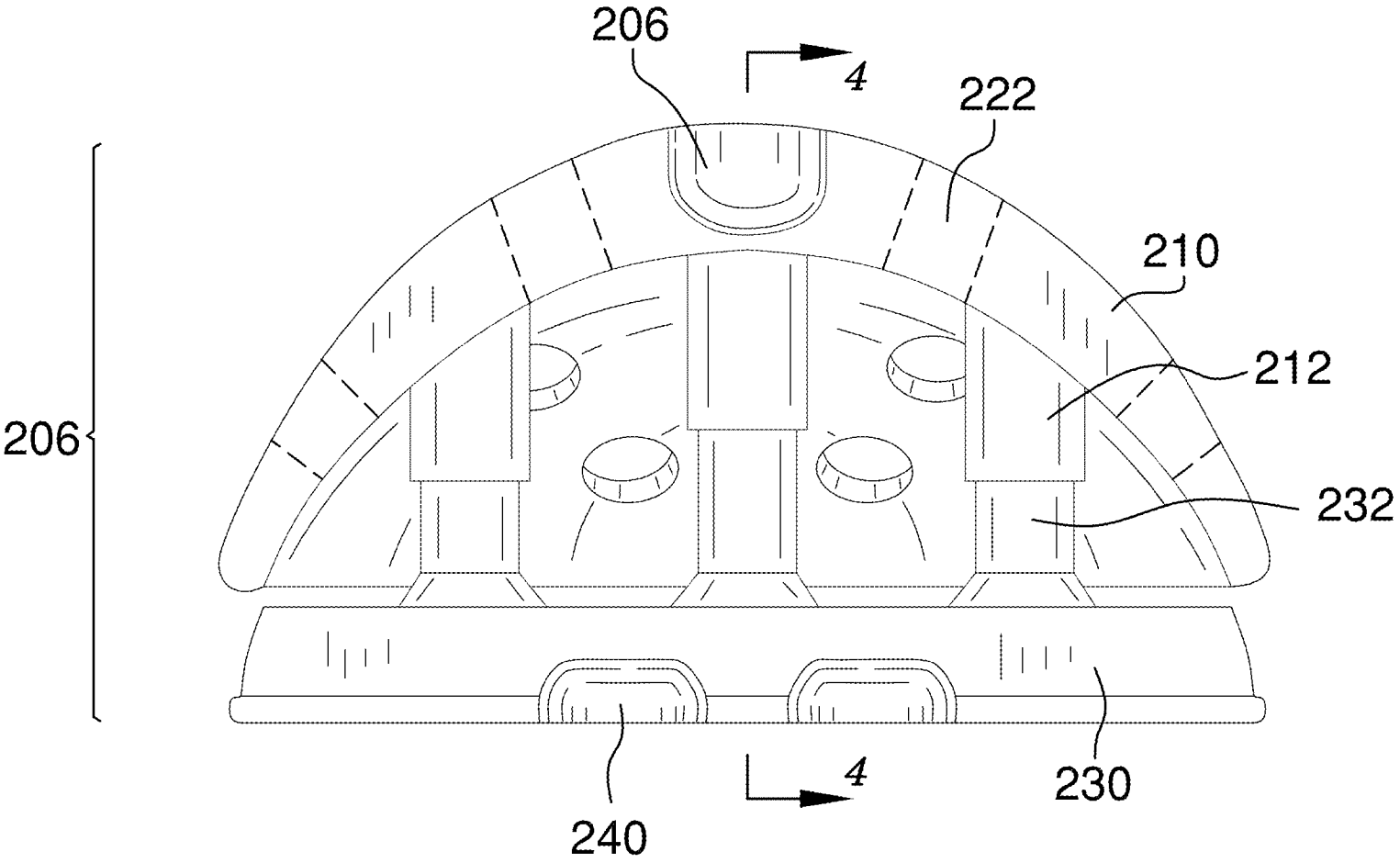
FIG. 2 is a rear view of an embodiment of the disclosure.
Figure 3:
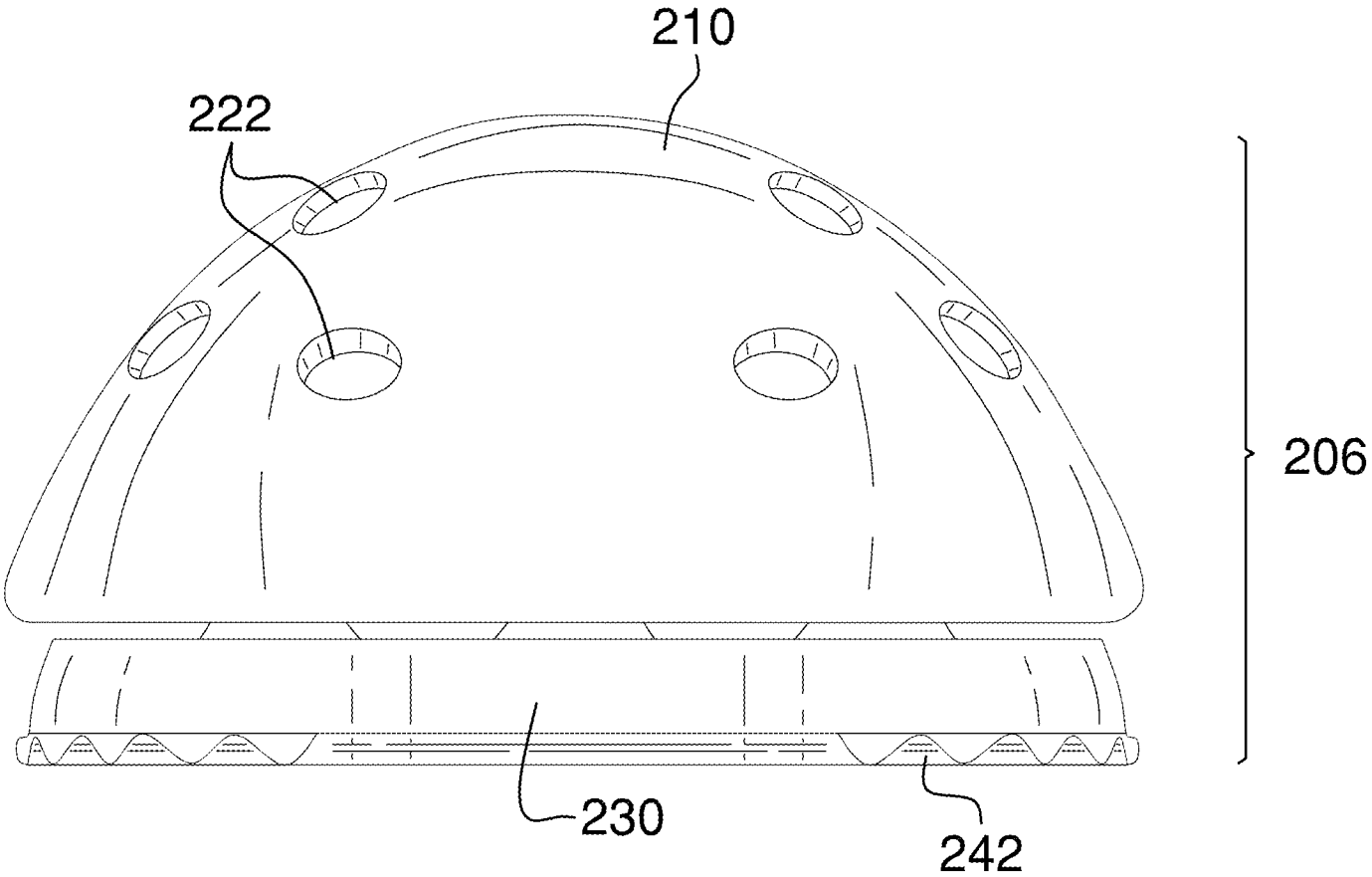
FIG. 3 is a front view of an embodiment of the disclosure.
Figure 4:
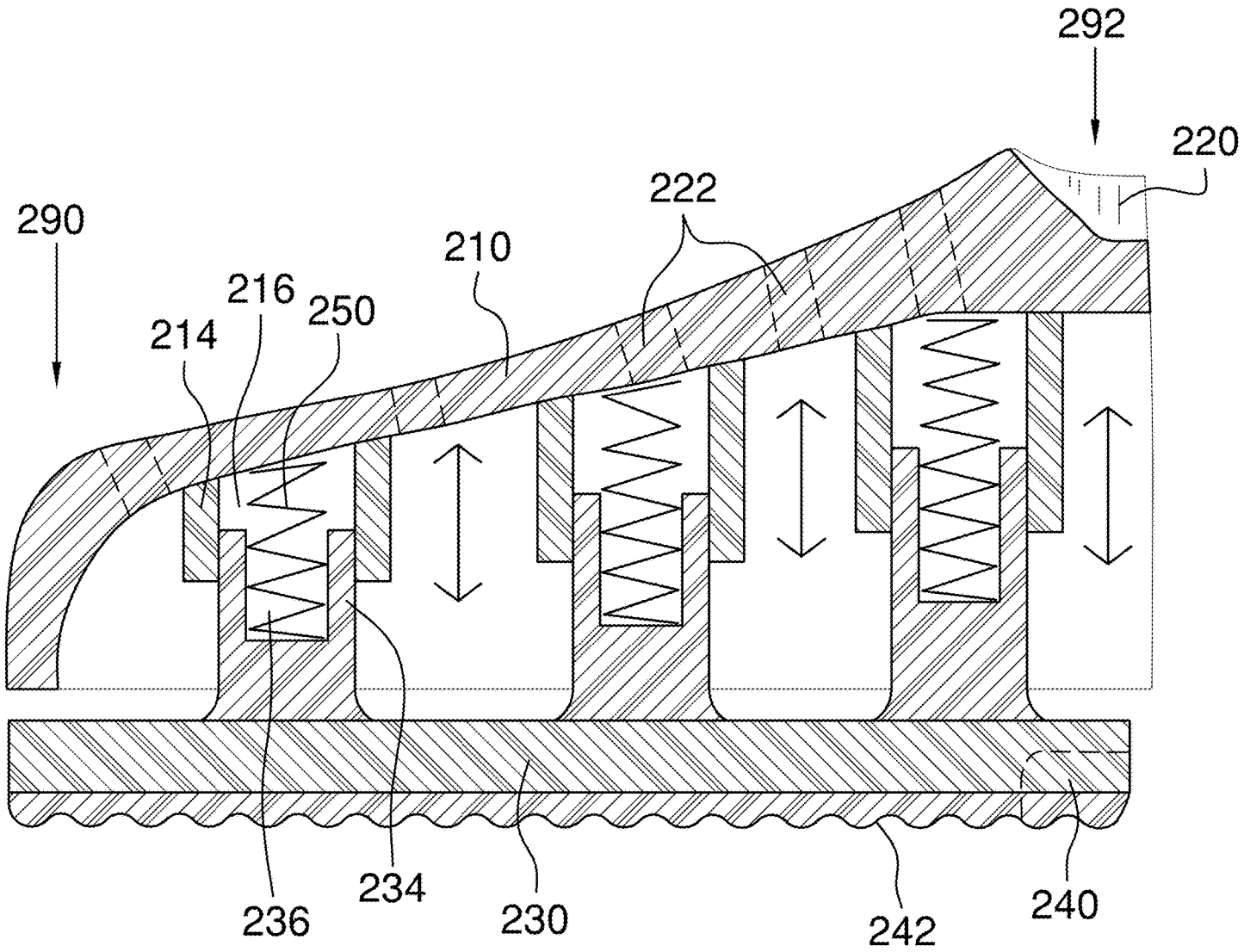
FIG. 4 is a cross-sectional view of an embodiment of the disclosure.
Figure 5:
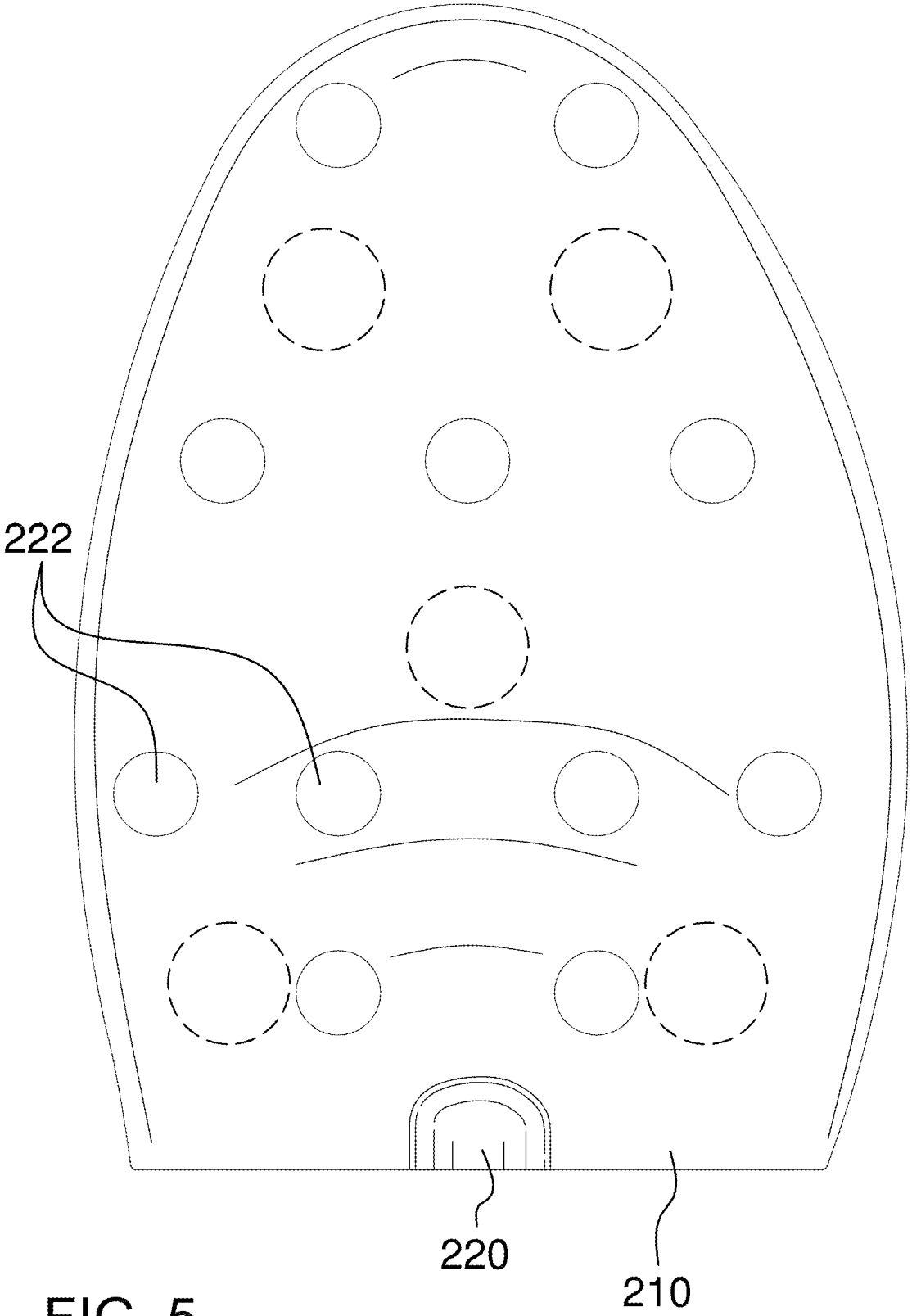
FIG. 5 is a top view of an embodiment of the disclosure.
Figure 6:
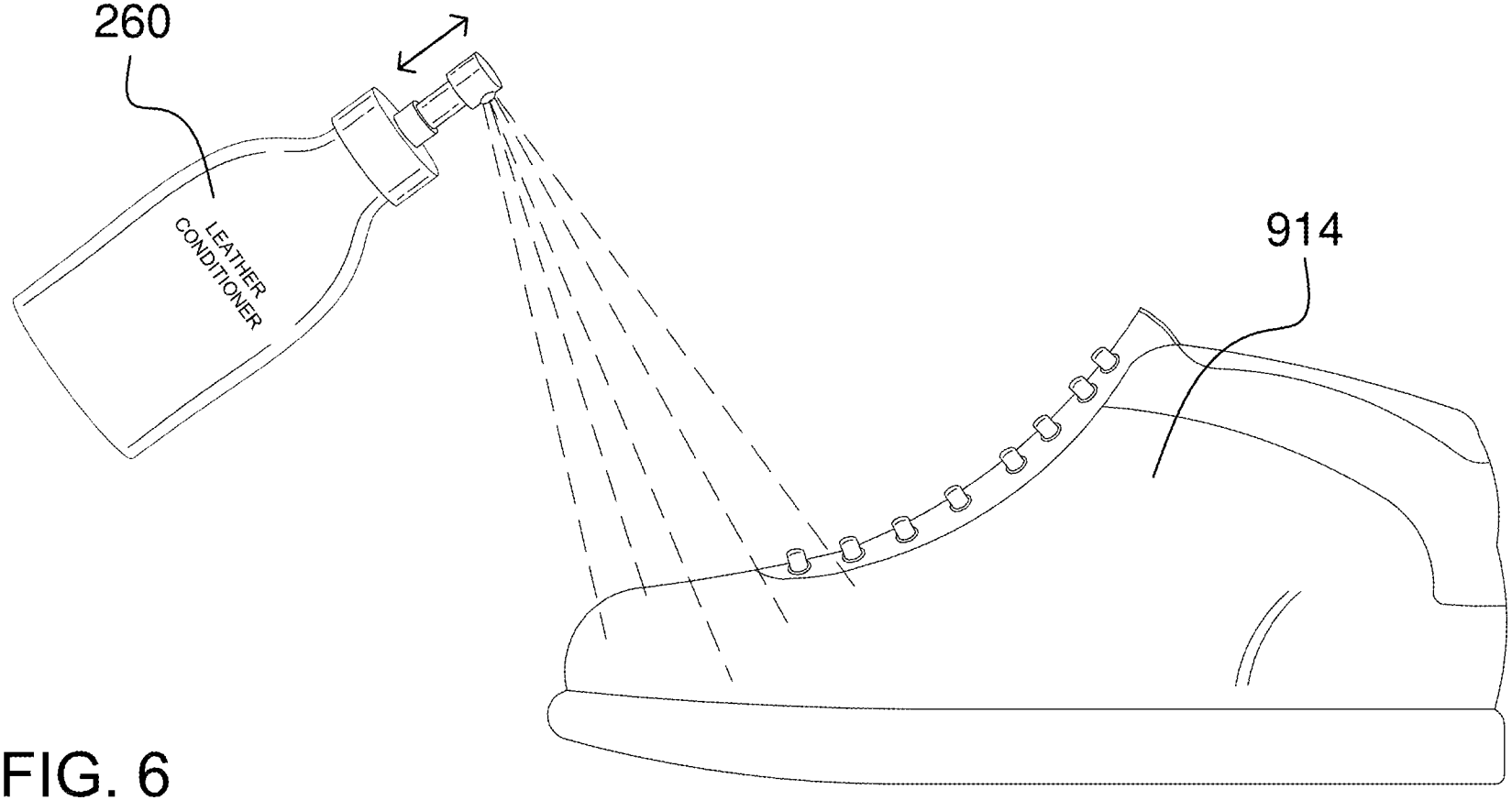
FIG. 6 is an in-use view of an embodiment of the disclosure, illustrating the application of shoe conditioner
Figure 7:
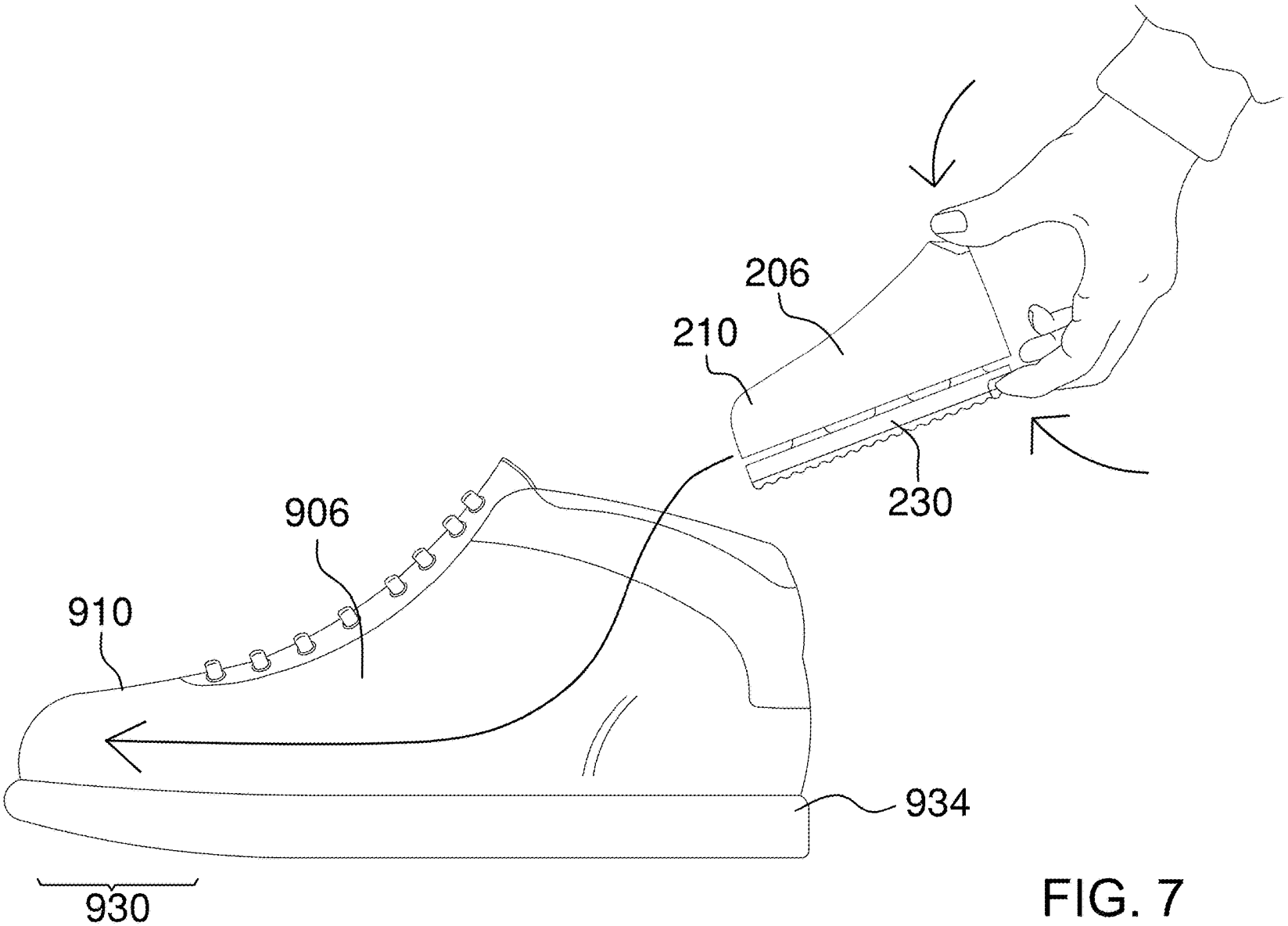
FIG. 7 is an in-use view of an embodiment of the disclosure, illustrating the insertion of a show stretcher into a shoe
Figure 8:
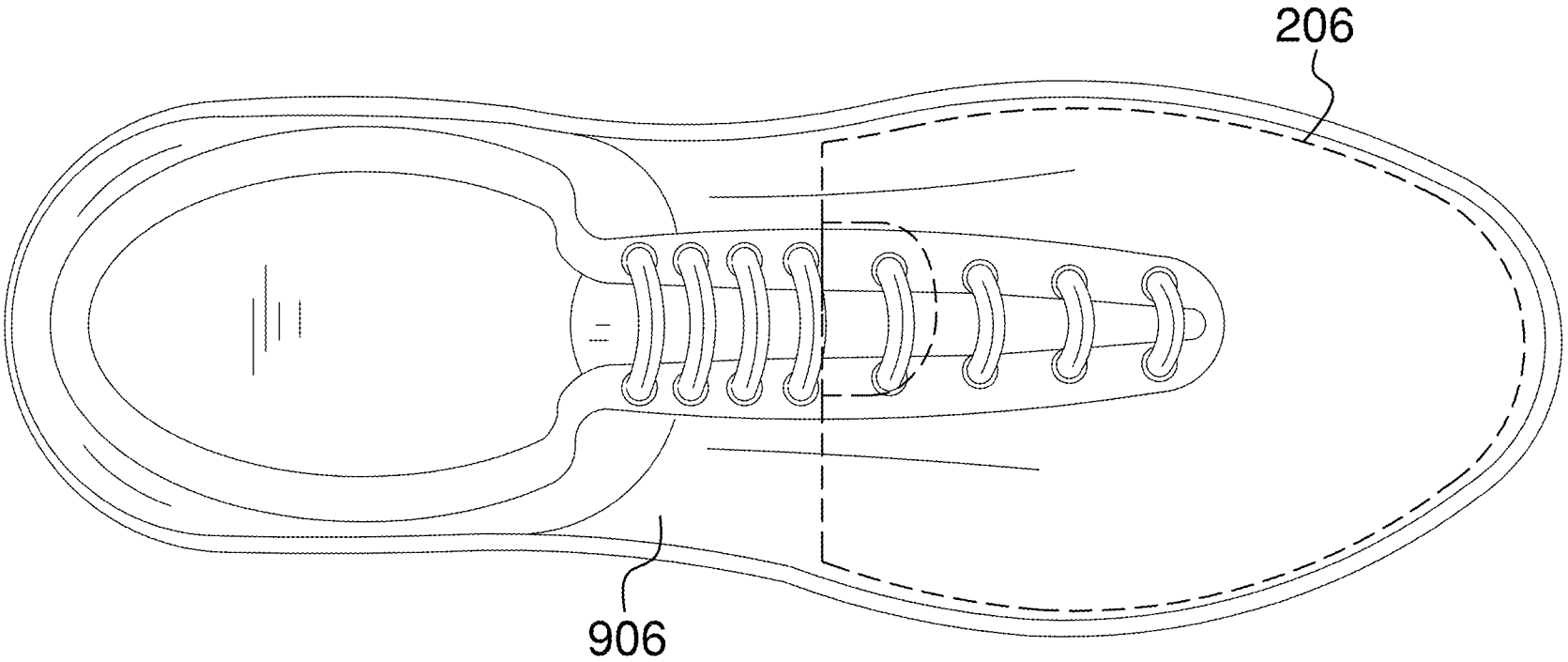
FIG. 8 is an in-use view of an embodiment of the disclosure, illustrating the position of the shoe stretcher within the shoe.

Detailed reference will now be made to a first potential embodiment of the disclosure, which is illustrated in FIGS. 1 through 8.

The shoe crease abatement system 100 (hereinafter invention) comprises a pair of shoe stretchers and shoe conditioner 260. The pair of shoe stretchers may be inserted into toe boxes 930 of a pair of shoes and may stretch the toe boxes 930 in a vertical direction to prevent creases from forming at folds across the tops of the pair of shoes. The shoe conditioner 260 may be applied to the pair of shoes to soften the pair of shoes in preparation for stretching. As non-limiting examples, the pair of shoes may be sneakers, running shoes, or leather shoes.

The pair of shoe stretchers may comprise a left shoe stretcher 202 for insertion into a left shoe and a right shoe stretcher 204 for insertion into a right shoe. As seen from above, the left shoe stretcher 202 and the right shoe stretcher 204 may be mirror images of each other.

An individual shoe stretcher 206 selected from the left shoe stretcher 202 and the right shoe stretcher 204 may comprise a top plate 210, a bottom plate 230, and a plurality of helical springs 250. The bottom plate 230 may rest on the insole 934 within the toe box 930 of an individual shoe 906. The top plate 210 may be positioned directly above the bottom plate 230. The plurality of helical springs 250 may force the top plate 210 and the bottom plate 230 to separate such that the top plate 210 may press upward against a toe box upper 910. The pressure applied to the toe box upper 910 from within may prevent the top of the individual shoe 906 from bending and forming the creases.

The top plate 210 may resemble one quarter of a hollow ellipsoid such that the top plate 210 matches the contour of the inside of the toe box upper 910. A plurality of top spring columns 212 may extend downward from the inside of the top plate 210. In some embodiments, the plurality of top spring columns 212 may extend downward by one half of the distance from the underside of the top plate 210 to the plane of the bottom of the top plate 210.

An individual top spring column selected from the plurality of top spring columns 212 may comprise a top spring column cylindrical wall 214 and a top spring column center well 216. The top spring column cylindrical wall 214 may be a hollow cylindrical wall extending vertically downward. The top spring column center well 216 may be a depression within the top spring column cylindrical wall 214 that extends upward towards the top plate 210.

The top plate 210 may comprise a plurality of airflow apertures 222. The plurality of airflow apertures 222 may be oriented to pass through the top plate 210 from the interior of the top plate 210 to the exterior of the top plate 210. The plurality of airflow apertures 222 may be operable to permit airflow through the top plate 210.

The top plate 210 may comprise indicia 224. The indicia 224 may be alphanumeric and/or graphical markings that designate whether the individual shoe stretcher 206 is intended to fit into the left shoe or the right shoe. The indicia 224 may be a left designation 226 on the left shoe stretcher 202 and a right designation 228 on the right shoe stretcher 204. The indicia 224 be debossed to prevent rubbing against the inside of the individual shoe 906.

The bottom plate 230 may be a flat plate shaped to match the footprint of the top plate 210. A plurality of bottom spring columns 232 may extend upward from the top surface of the bottom plate 230. The plurality of bottom spring columns 232 may extend upward such that the plurality of bottom spring columns 232 fit into and overlap with the plurality of top spring columns 212 when the top plate 210 is place onto the bottom plate 230 in the absence of the plurality of helical springs 250.

An individual bottom spring column selected from the plurality of bottom spring columns 232 may comprise a bottom spring column cylindrical wall 234 and a bottom spring column center well 236. The bottom spring column cylindrical wall 234 may be a hollow cylindrical wall extending vertically upward.

The bottom spring column center well 236 may be a depression within the bottom spring column cylindrical wall 234 that extends downward towards the bottom plate 230.

The outside diameter of the bottom spring column cylindrical wall 234 may be less than the inside diameter of the top spring column center well 216 such that the individual bottom spring column may fit into the individual top spring column. The inside diameter of the bottom spring column center well 236 may be larger than the diameter of an individual spring selected from the plurality of helical springs 250 such that the individual spring may fit into the bottom spring column center well 236.

The plurality of bottom spring columns 232 may have a one-to-one pairing with the plurality of top spring columns 212. Each of the individual bottom spring column may mate with one of the plurality of top spring columns 212.

The plurality of helical springs 250 may push the top plate 210 up away from the bottom plate 230 such that force is applied to the toe box upper 910. The individual springs may be positioned in the bottom spring column center wells 236 and extend up into the top spring column center wells 216. An individual pairing of one top spring column, one bottom spring column, and one spring may be referred to as a spring column.

The top plate 210 may comprise one or more top finger indentations 220 and the bottom plate 230 may comprise one or more bottom finger indentations 240. The one or more top finger indentations 220 may be located on the rear 292 edge of the top plate 210 and the one or more bottom finger indentations 240 may be located on the rear 292 edge of the bottom plate 230. The one or more top finger indentations 220 and the one or more top finger indentations 220 may be adapted for a user to grasp the individual shoe stretcher 206 by placing fingers onto the one or more top finger indentations 220 and the one or more bottom finger indentations 240. The one or more top finger indentations 220 and the one or more bottom finger indentations 240 may be adapted for the user to compress the plurality of helical springs 250 while inserting and removing the individual shoe stretcher 206 by squeezing the top plate 210 and the bottom plate 230 together.

The bottom of the bottom plate 230 may comprise a gripping surface 242. The gripping surface 242 may increase the friction of the bottom of the bottom plate 230 to prevent the individual shoe stretcher 206 from sliding within the individual shoe 906. The gripping surface 242 may increase friction by providing a non-planar surface, a different material, or both.

In a preferred embodiment, there may be five spring columns. The five spring columns may be organized as two front spring columns, two rear spring columns, and one center spring column.

The shoe conditioner 260 may be sprayed onto the individual shoe 906 from a spray bottle 262 via a spray nozzle 264. The shoe conditioner 260 may moisturize the individual shoe 906 to prevent cracking, may create a protective barrier on the individual shoe 906, or both. As a non-limiting example, the shoe conditioner 260 may be a leather conditioner.

As non-limiting examples, the individual shoe stretcher 206 may be inserted into the individual shoe 906 by placing the front 290 of the individual shoe stretcher 206 into the toe box 930, by squeezing the top plate 210 and the bottom plate 230 together using the one or more top finger indentations 220 and the one or more bottom finger indentations 240, by sliding the individual shoe stretcher 206 towards the front 290, and by releasing the one or more top finger indentations 220 and the one or more bottom finger indentations 240. The individual shoe stretcher 206 may be removed by squeezing the top plate 210 and the bottom plate 230 together using the one or more top finger indentations 220 and the one or more bottom finger indentations 240, by sliding the individual shoe stretcher 206 towards the rear 292, by lifting the individual shoe stretcher 206 from the individual shoe 906, and by releasing the one or more top finger indentations 220 and the one or more bottom finger indentations 240.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface or object. Aperture may be synonymous with hole, slit, crack, gap, slot, or opening.

In this disclosure, "compress" may refer to forcing into a smaller space.

As used in this disclosure, the word "exterior" may be used as a relational term that implies that an object is not located or contained within the boundary of a structure or a space.

As used here, "footprint" may refer to a projection of an object onto the surface that supports the object. The projection is usually, but not always, vertically downward.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used in this disclosure, a "helix" may be the three dimensional structure that is formed by a wire that is wound uniformly around the surface of a cylinder or a cone. If the wire is wrapped around a cylinder the helix is called a cylindrical helix. If the wire is wrapped around a cone, the helix is called a conical helix. "Helical" may be an adjective which indicates that an object is shaped like a helix.

As used in this disclosure, the term "indicia" may refer to one or more markings that identify a sentiment.

As used herein, "inside diameter" or "inner diameter" may refer to a measurement made on a hollow object. Specifically, the inside diameter is the distance from one inside wall to the opposite inside wall.

As used in this disclosure, the "insole" may be the component of a shoe sole that is proximal to the wearer's foot.

As used in this disclosure, the word "interior" may be used as a relational term that implies that an object is located or contained within the boundary of a structure or a space.

As used herein, "mate" may refer to a retaining, coupling, connecting, interlocking, or interfacing at a predefined interface.

As used herein, the term "mirror image" may refer to an object that has its parts reversely arranged in comparison with another similar object or that is reversed with reference to an intervening axis or plane.

As used herein, "outside diameter" or "outer diameter" may refer to a measurement made on an object. Specifically, the outside diameter is the distance from one point on the outside of the object to a point on the opposite side of the object along a line passing through the center of the object.

As used herein, the words "printed", "marked", and "marking" may refer to a mark that has been made on an object. The process of making the mark may involve printing, lithography, thermal transfer, painting, embossing, debossing, molding, burning, punching, silk-screening, drawing, etching, engraving, stenciling, stamping, spraying of pigments, applying adhesive tape, or other processes which result in the controlled change of coloration and/or shape of a surface.

As used in this disclosure, a "spray nozzle" may be a device that receives liquid under pressure and disperses that liquid into the atmosphere as a spray.

As used in this disclosure, a "spring" may be a device that is used to store mechanical energy. This mechanical energy will often be stored by deforming an elastomeric material that is used to make the device, by the application of a torque to a rigid structure, or by a combination thereof. In some embodiments, the rigid structure to which torque is applied may be composed of metal or plastic.

As used in this disclosure, "vertical" may refer to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 8, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A shoe crease abatement system comprising:

a pair of shoe stretchers and shoe conditioner;

wherein the pair of shoe stretchers are inserted into toe boxes of a pair of shoes and stretch the toe boxes in a vertical direction to prevent creases from forming at folds across the tops of the pair of shoes;

wherein the shoe conditioner is applied to the pair of shoes to soften the pair of shoes in preparation for stretching;

wherein an individual shoe stretcher selected from the left shoe stretcher and the right shoe stretcher comprises a top plate, a bottom plate, and a plurality of helical springs;

wherein the plurality of helical springs force the top plate and the bottom plate to separate such that the top plate presses upward against a toe box upper;

wherein the pressure applied to the toe box upper from within prevents the top of the individual shoe from bending and forming the creases;

wherein an individual top spring column selected from the plurality of top spring columns comprises a top spring column cylindrical wall and a top spring column center well;

wherein the top spring column cylindrical wall is a hollow cylindrical wall extending vertically downward;

wherein the top spring column center well is a depression within the top spring column cylindrical wall that extends upward towards the top plate.

2. The shoe crease abatement system according to claim 1 wherein the pair of shoe stretchers comprise a left shoe stretcher for insertion into a left shoe and a right shoe stretcher for insertion into a right shoe;

wherein the left shoe stretcher and the right shoe stretcher are mirror images of each other.

3. The shoe crease abatement system according to claim 2 wherein the bottom plate rests on the insole within the toe box of an individual shoe;

wherein the top plate is positioned directly above the bottom plate.

4. The shoe crease abatement system according to claim 3 wherein the top plate resembles one quarter of a hollow ellipsoid such that the top plate matches the contour of the inside of the toe box upper.

5. The shoe crease abatement system according to claim 4 wherein a plurality of top spring columns extend downward from the inside of the top plate.

6. The shoe crease abatement system according to claim 5 wherein the plurality of top spring columns extend downward by one half of the distance from the underside of the top plate to the plane of the bottom of the top plate.

7. The shoe crease abatement system according to claim 5 wherein the top plate comprises a plurality of airflow apertures;

wherein the plurality of airflow apertures are oriented to pass through the top plate from the interior of the top plate to the exterior of the top plate;

wherein the plurality of airflow apertures are operable to permit airflow through the top plate.

8. The shoe crease abatement system according to claim 7 wherein the top plate comprises indicia;

wherein the indicia is alphanumeric and/or graphical markings that designate whether the individual shoe stretcher is intended to fit into the left shoe or the right shoe;

wherein the indicia is a left designation on the left shoe stretcher and a right designation on the right shoe stretcher;

wherein the indicia be debossed to prevent rubbing against the inside of the individual shoe.

9. The shoe crease abatement system according to claim 8 wherein the bottom plate is a flat plate shaped to match the footprint of the top plate.

10. The shoe crease abatement system according to claim 9 wherein a plurality of bottom spring columns extend upward from the top surface of the bottom plate;

wherein the plurality of bottom spring columns extend upward such that the plurality of bottom spring columns fit into and overlap with the plurality of top spring columns when the top plate is place onto the bottom plate in the absence of the plurality of helical springs.

11. The shoe crease abatement system according to claim 10 wherein an individual bottom spring column selected from the plurality of bottom spring columns comprises a bottom spring column cylindrical wall and a bottom spring column center well;

wherein the bottom spring column cylindrical wall is a hollow cylindrical wall extending vertically upward;

wherein the bottom spring column center well is a depression within the bottom spring column cylindrical wall that extends downward towards the bottom plate.

12. The shoe crease abatement system according to claim 11 wherein the outside diameter of the bottom spring column cylindrical wall is less than the inside diameter of the top spring column center well such that the individual bottom spring column fits into the individual top spring column;

wherein the inside diameter of the bottom spring column center well is larger than the diameter of an individual spring selected from the plurality of helical springs such that the individual spring fits into the bottom spring column center well.

13. The shoe crease abatement system according to claim 12 wherein the plurality of bottom spring columns have a one-to-one pairing with the plurality of top spring columns;

wherein each of the individual bottom spring column mates with one of the plurality of top spring columns.

14. The shoe crease abatement system according to claim 13 wherein the plurality of helical springs push the top plate up away from the bottom plate such that force is applied to the toe box upper;

wherein the individual springs are positioned in the bottom spring column center wells and extend up into the top spring column center wells;

wherein an individual pairing of one top spring column, one bottom spring column, and one spring is referred to as a spring column.

15. The shoe crease abatement system according to claim 14 wherein the top plate comprises one or more top finger indentations and the bottom plate comprises one or more bottom finger indentations;

wherein the one or more top finger indentations are located on the rear edge of the top plate and the one or more bottom finger indentations are located on the rear edge of the bottom plate;

wherein the one or more top finger indentations and the one or more top finger indentations are adapted for a user to grasp the individual shoe stretcher by placing fingers onto the one or more top finger indentations and the one or more bottom finger indentations;

wherein the one or more top finger indentations and the one or more bottom finger indentations are adapted for the user to compress the plurality of helical springs while inserting and removing the individual shoe stretcher by squeezing the top plate and the bottom plate together.

16. The shoe crease abatement system according to claim 15 wherein the bottom of the bottom plate comprises a gripping surface;

wherein the gripping surface increases the friction of the bottom of the bottom plate to prevent the individual shoe stretcher from sliding within the individual shoe;

wherein the gripping surface increases friction by providing a non-planar surface, a different material, or both.

17. The shoe crease abatement system according to claim 16 wherein there are five spring columns;

wherein the five spring columns are organized as two front spring columns, two rear spring columns, and one center spring column.

18. The shoe crease abatement system according to claim 16 wherein the shoe conditioner is sprayed onto the individual shoe from a spray bottle via a spray nozzle;

wherein the shoe conditioner moisturizes the individual shoe to prevent cracking, creates a protective barrier on the individual shoe, or both.

19. The shoe crease abatement system according to claim 18 wherein the individual shoe stretcher is inserted into the individual shoe by placing the front of the individual shoe stretcher into the toe box, by squeezing the top plate and the bottom plate together using the one or more top finger indentations and the one or more bottom finger indentations, by sliding the individual shoe stretcher towards the front, and by releasing the one or more top finger indentations and the one or more bottom finger indentations;

wherein the individual shoe stretcher is removed by squeezing the top plate and the bottom plate together using the one or more top finger indentations and the one or more bottom finger indentations, by sliding the individual shoe stretcher towards the rear, by lifting the individual shoe stretcher from the individual shoe, and by releasing the one or more top finger indentations and the one or more bottom finger indentations.

* * * * *